US010927638B2

(12) United States Patent
Ezell et al.

(10) Patent No.: US 10,927,638 B2
(45) Date of Patent: Feb. 23, 2021

(54) WELLBORE ISOLATION DEVICE WITH TELESCOPING SETTING SYSTEM

(71) Applicant: HALLIBURTON ENERGY SERVICES, INC., Houston, TX (US)

(72) Inventors: Michael Dale Ezell, Cassville, MO (US); Beauford Sean Mallory, Sachse, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 115 days.

(21) Appl. No.: 16/322,450

(22) PCT Filed: Sep. 14, 2016

(86) PCT No.: PCT/US2016/051620

§ 371 (c)(1),
(2) Date: Jan. 31, 2019

(87) PCT Pub. No.: WO2018/052404

PCT Pub. Date: Mar. 22, 2018

(65) Prior Publication Data

US 2019/0203559 A1 Jul. 4, 2019

(51) Int. Cl.
*E21B 33/1295* (2006.01)
*E21B 33/134* (2006.01)
(Continued)

(52) U.S. Cl.
CPC ..... *E21B 33/1295* (2013.01); *E21B 23/10* (2013.01); *E21B 33/134* (2013.01); *E21B 33/1293* (2013.01); *E21B 2200/06* (2020.05)

(58) Field of Classification Search
CPC . E21B 33/1295; E21B 33/134; E21B 33/1293
See application file for complete search history.

(56) References Cited

U.S. PATENT DOCUMENTS 3,410,348 A * 11/1968 Page ..... E21B 33/1295 166/120
4,805,699 A 2/1989 Halbardier
(Continued)

OTHER PUBLICATIONS

Patent Cooperation Treaty, International Search Report and Written Opinion, PCT Appln. No. PCT/US2016/051620, dated May 10, 2017.

*Primary Examiner* — Robert E Fuller
(74) *Attorney, Agent, or Firm* — McGuireWoods LLP

(57) ABSTRACT

A wellbore isolation is introduced into a wellbore and includes an elongate body defining an interior and comprising an upper sub, a lower sub, and a mandrel extending therebetween. A sealing element is disposed about the mandrel and upper and lower slip assemblies are positioned on opposing axial ends of the sealing element. A setting piston is positioned within a piston chamber defined by the lower sub and the mandrel, and a mandrel plugging device is positioned within the mandrel. The mandrel plugging device plugs the interior and transitions between occluding setting ports defined in the mandrel and exposed the setting ports to facilitate fluid communication between the interior and the piston chamber. The interior is pressurized to actuate the setting piston and set the lower slip assembly, and further pressurized to move the mandrel and set the upper slip assembly.

18 Claims, 4 Drawing Sheets

(51) Int. Cl.
*E21B 33/129* (2006.01)
*E21B 23/10* (2006.01)

(56) References Cited

U.S. PATENT DOCUMENTS

| | | | |
|---|---|---|---|
| 8,967,268 | B2 | 3/2015 | Urban et al. |
| 9,187,970 | B2 | 11/2015 | Coles et al. |
| 2005/0011678 | A1 | 1/2005 | Akinlade et al. |
| 2013/0180732 | A1 | 7/2013 | Acosta et al. |

* cited by examiner

WELLBORE ISOLATION DEVICE WITH TELESCOPING SETTING SYSTEM

BACKGROUND

In the drilling, completion, and stimulation of hydrocarbon-producing wells, a variety of downhole tools are used. For example, during hydraulic fracturing operations it is required to seal portions of a wellbore to allow fluid to be pumped into the wellbore and forced out under pressure into surrounding subterranean formations. Wellbore isolation devices, such as packers, bridge plugs, and fracturing plugs (alternately referred to as "frac" plugs) are designed for this purpose.

Typical wellbore isolation devices include a body and a sealing element disposed about the body to generate a fluidic seal within the wellbore. Upon reaching a desired location within the wellbore, the wellbore isolation device is actuated, which causes the sealing element to expand radially outward and into sealing engagement with the inner wall of the wellbore, or alternatively with casing or other wellbore tubing that lines or is otherwise positioned in the wellbore. Upon setting the sealing element, migration of fluids across the wellbore isolation device is substantially prevented, which fluidly isolates the axially adjacent upper and lower sections of the wellbore.

Some hydraulically actuated wellbore isolation devices include upper and lower slips axially engageable with the sealing element and operatively coupled to a setting piston and a mandrel. In setting such wellbore isolation devices, hydraulic pressure acts on the setting piston, which forces the slips into axial engagement with the sealing element to compress and radially expand the sealing element. If the setting piston has a small piston area, however, it may be difficult to generate enough setting force to fully set the slips and compress the sealing element. This setting force limitation from a small piston area is typically the result of internal pressure restrictions of the body of the wellbore isolation device, a work string that conveys the wellbore isolation device downhole, or it may be limited by pressure restrictions of equipment uphole of the wellbore isolation device, such as a safety valve or a wellhead.

With most hydraulically actuated wellbore isolation devices there is the potential for achieving additional slip and sealing element setting by allowing the piston area of the plugged inner diameter of the wellbore isolation device to act on the mandrel and help drive the upper and lower slips toward each other. Such axial movement of the mandrel, however, often places the work string above the wellbore isolation device in significant tension or stretch, which can have adverse effects on the long-term performance of the sealing element and/or future operations for the wellbore isolation device.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to downhole tools used in the oil and gas industry and, more particularly, to wellbore isolation devices that incorporate a setting piston and a telescoping mandrel for helping set a sealing element within a wellbore.

The embodiments disclosed herein describe a telescoping wellbore isolation device that can be conveyed into a wellbore on a conveyance. The wellbore isolation device has the ability to fully set within the wellbore with lower applied setting pressure and without inducing excessive tension or stretch in the conveyance. The wellbore isolation device includes an elongate body that defines an interior and comprises an upper sub, a lower sub, and a mandrel extending between the upper and lower subs. A sealing element is disposed about the mandrel, and upper and lower slip assemblies are positioned on opposing axial ends of the sealing element. A setting piston is positioned within a piston chamber cooperatively defined by the lower sub and the mandrel, and a mandrel plugging device is positioned within the mandrel to plug the interior. The mandrel plugging device is able to transition from a first state, where the mandrel plugging device occludes setting ports defined in the mandrel, to a second state, where the setting ports are exposed to facilitate fluid communication between the interior and the piston chamber. Pressurizing the interior to a first pressure actuates the setting piston to set the lower slip assembly within the casing, and pressurizing the interior to a second pressure (greater than or equal to the first pressure) moves the mandrel with respect to the upper sub and sets the upper slip assembly within the casing.

Figure 1:
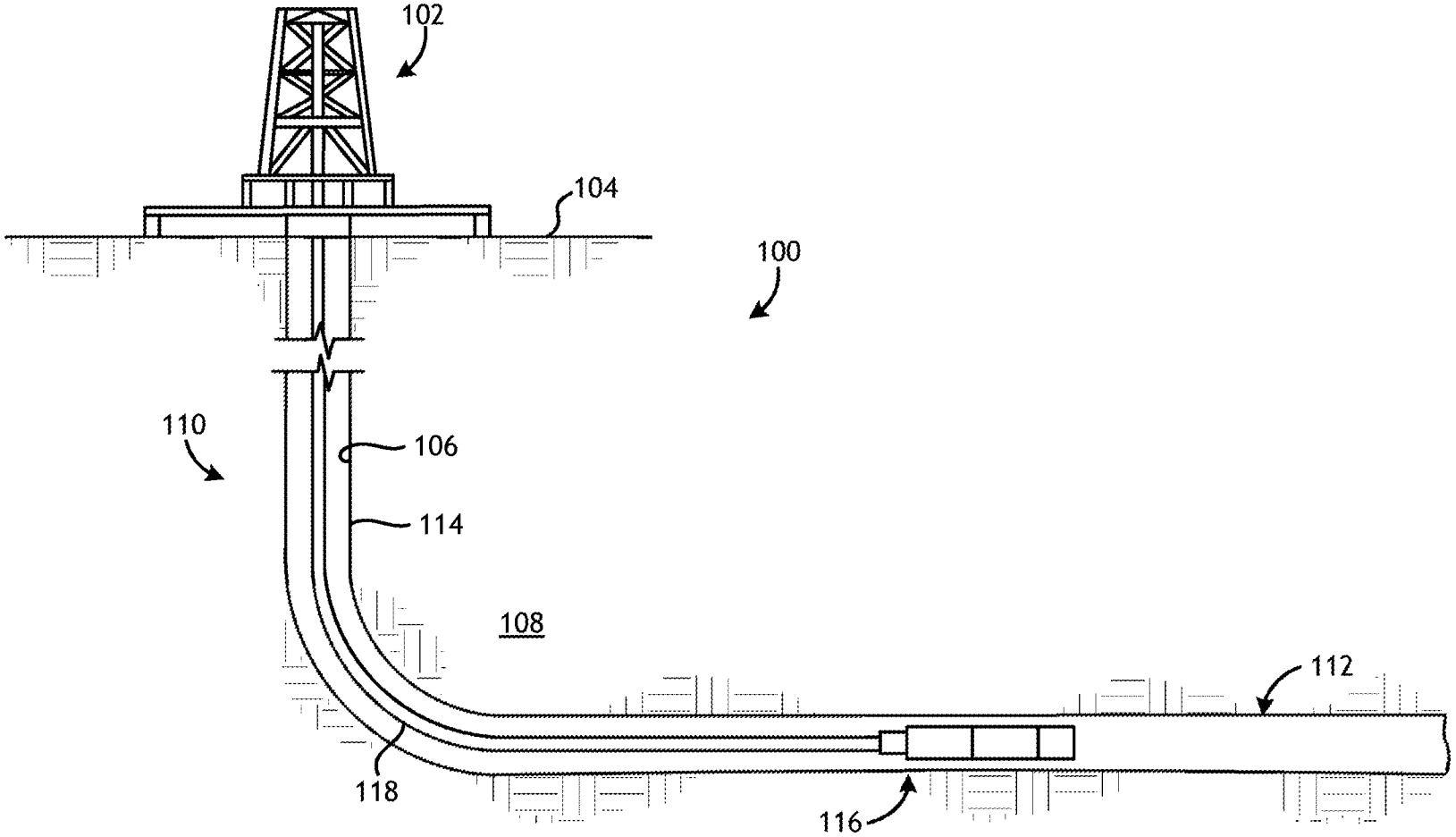
FIG. 1 is a schematic diagram of a well system that may employ one or more principles of the present disclosure.

Referring to FIG. 1, illustrated is a well system 100 that may incorporate the principles of the present disclosure, according to one or more embodiments. As illustrated, the well system 100 may include a service rig 102 that is positioned on the Earth's surface 104 and extends over and around a wellbore 106 that penetrates a subterranean formation 108. The service rig 102 may comprise a drilling rig, a completion rig, a workover rig, or the like. In some embodiments, the service rig 102 may be omitted and replaced with a standard surface wellhead completion or installation, without departing from the scope of the disclosure. While the well system 100 is depicted as a land-based operation, the principles of the present disclosure could equally be applied in any sea-based or sub-sea application where the service rig 102 may be a floating platform or sub-surface wellhead installation, as generally known in the art.

The wellbore 106 may be drilled into the subterranean formation 108 using any suitable drilling technique and may extend in a substantially vertical direction away from the Earth's surface 104 over a vertical wellbore portion 110. At some point in the wellbore 106, the vertical wellbore portion 110 may deviate from vertical and transition into a substantially horizontal wellbore portion 112. In some embodiments, the wellbore 106 may be completed by cementing a string of casing 114 within the wellbore 106 along all or a portion thereof. In other embodiments, however, the casing 114 may be omitted from all or a portion of the wellbore 106 and the principles of the present disclosure may alternatively apply to an "open-hole" environment.

The system 100 may further include a wellbore isolation device 116 that may be conveyed into the wellbore 106 on a conveyance 118 that extends from the service rig 102. The wellbore isolation device 116 may include any type of casing or borehole isolation device known to those skilled in the art. Example wellbore isolation devices 116 include, but are not limited to, a frac plug, a bridge plug, a wellbore production packer, wellbore test packer, a wiper plug, a cement plug, a sliding sleeve, or any combination thereof. The conveyance 118 that delivers the wellbore isolation device 116 downhole may be, but is not limited to, coiled tubing, drill pipe, production tubing, or the like.

The wellbore isolation device 116 may be conveyed downhole to a target location within the wellbore 106. In some embodiments, the wellbore isolation device 116 is pumped to the target location using hydraulic pressure applied from the service rig 102. In such embodiments, the conveyance 118 serves to maintain control of the wellbore isolation device 116 as it traverses the wellbore 106 and provides the necessary power to actuate and set the wellbore isolation device 116 upon reaching the target location. In other embodiments, the wellbore isolation device 116 freely falls to the target location under the force of gravity. Upon reaching the target location, the wellbore isolation device 116 may be actuated or "set" and thereby provide a point of fluid isolation within the wellbore 106.

Even though FIG. 1 depicts the wellbore isolation device 116 as being arranged and operating in the horizontal portion 112 of the wellbore 106, the embodiments described herein are equally applicable for use in portions of the wellbore 106 that are vertical, deviated, curved, or otherwise slanted. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the second direction being toward the surface of the well and the downhole direction being toward the toe of the well.

Figure 2:
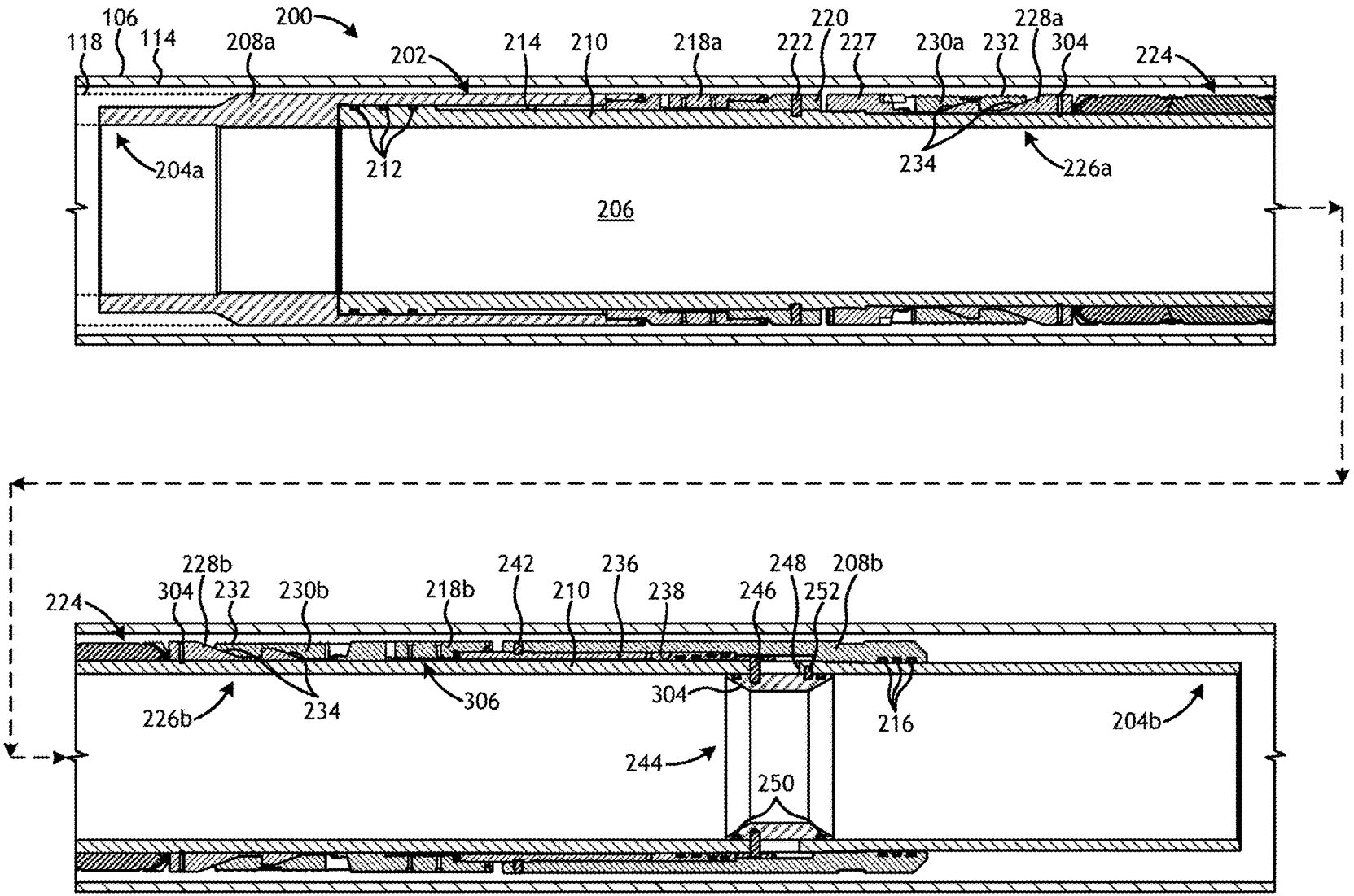
FIG. 2 depicts a cross-sectional side view of an exemplary wellbore isolation device in an unset configuration.
Figure 3:
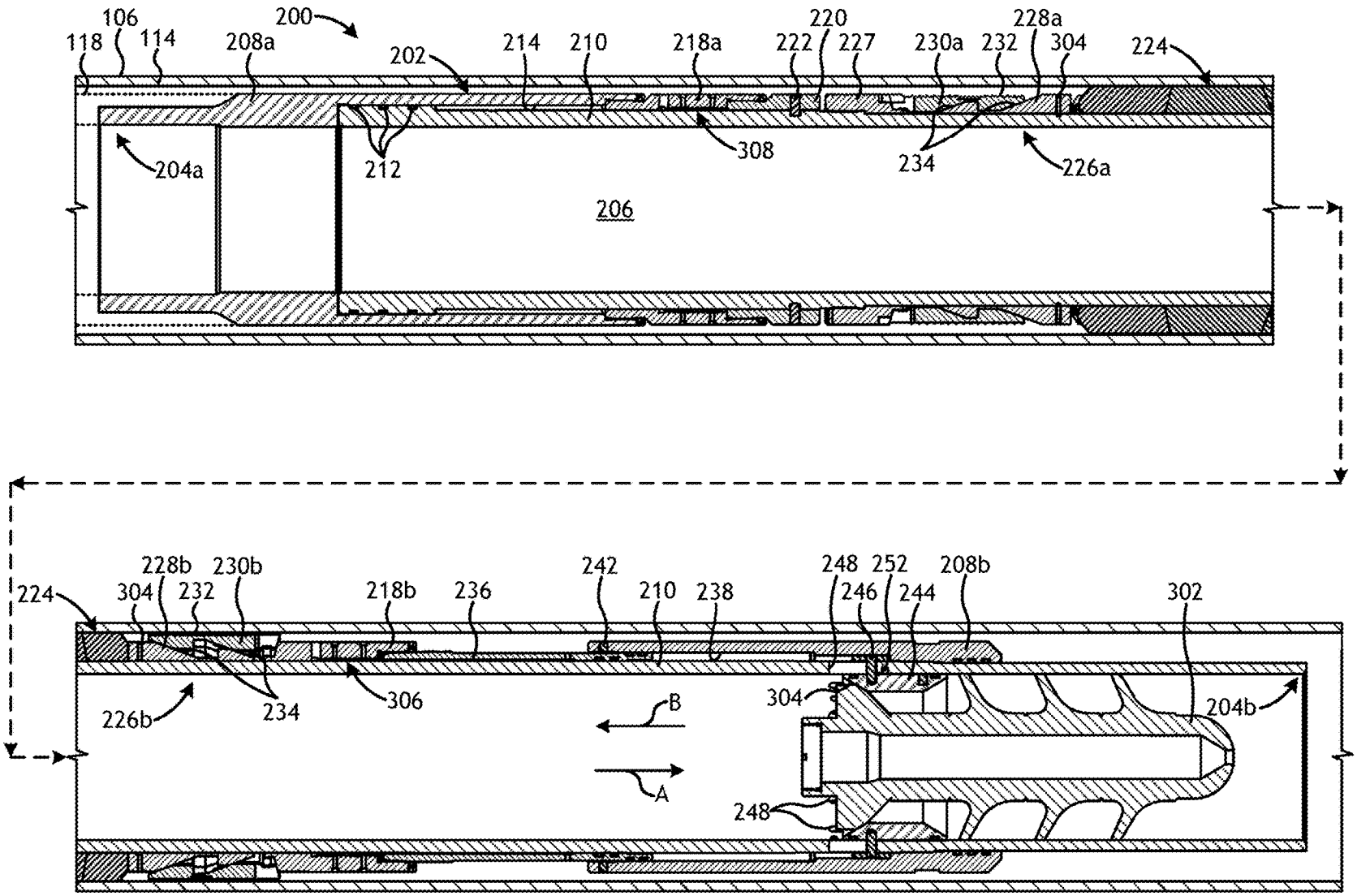
FIG. 3 depicts a cross-sectional side view of the wellbore isolation device of FIG. 2 in a partially set configuration.
Figure 4:
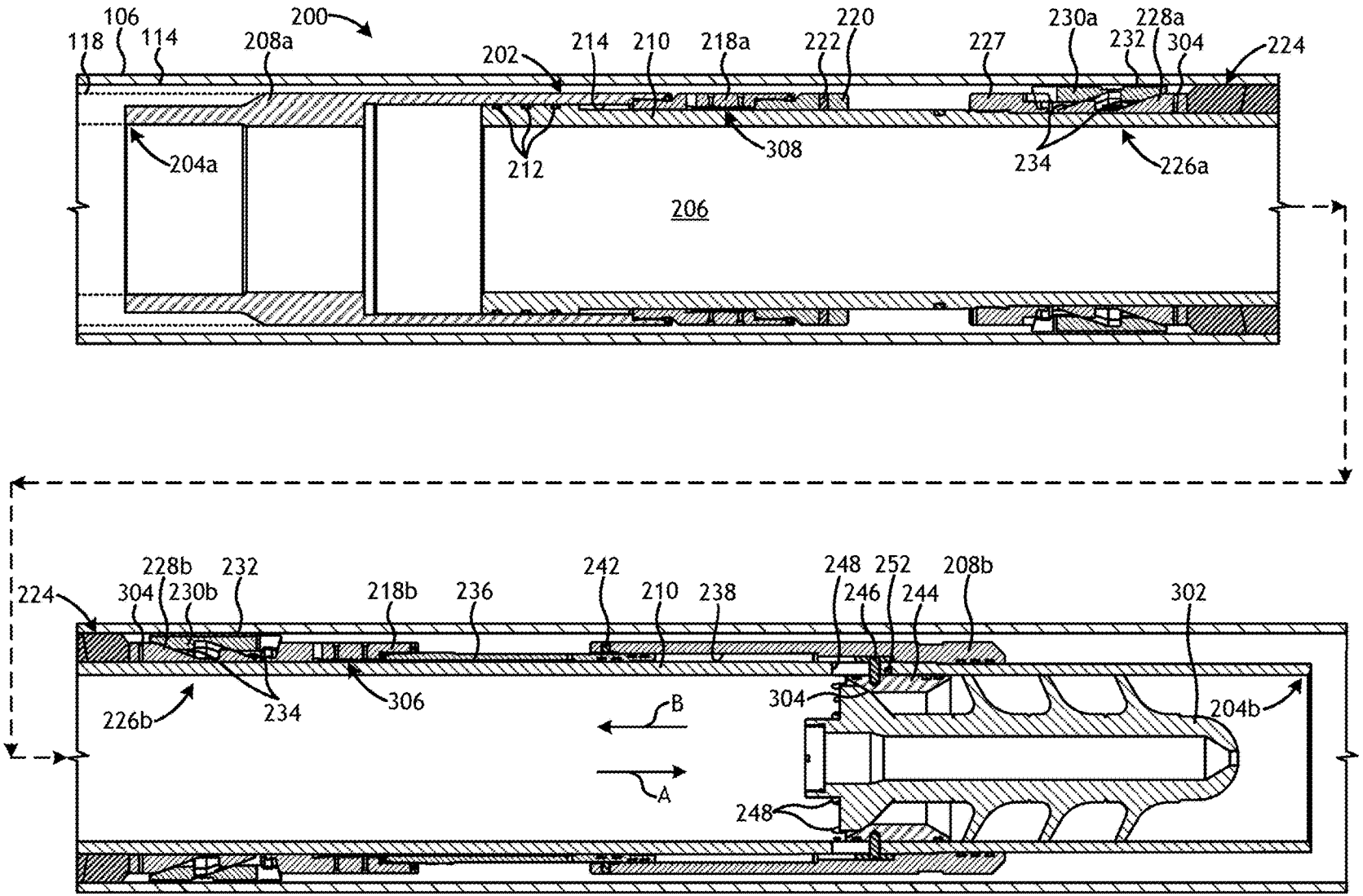
FIG. 4 depicts a cross-sectional side view of the wellbore isolation device of FIG. 2 in a fully set configuration.

FIGS. 2, 3, and 4 are progressive cross-sectional side views of an exemplary wellbore isolation device 200, according to one or more embodiments. More particularly, FIG. 2 depicts the wellbore isolation device 200 (hereafter "the device 200") in a run-in or unset configuration, FIG. 3 depicts the device 200 in a partially set configuration, and FIG. 4 depicts the device 200 in a fully set configuration. The device 200 may be the same as or similar to the wellbore isolation device 116 of FIG. 1. Accordingly, the device 200 may be extendable within the wellbore 106, which may be lined with casing 114. In some embodiments, however, the casing 114 may be omitted and the device 200 may alternatively be deployed in an open-hole section of the wellbore 106, without departing from the scope of this disclosure.

Referring first to FIG. 2, as illustrated, the device 200 may include an elongate, cylindrical body 202 having a first or "uphole" end 204*a*, a second or "downhole" end 204*b* and an interior 206 defined within the body 202 and extending between the first and second ends 204*a,b*. At the first end 204*a*, the body 202 may be coupled to the conveyance 118 (shown in dashed lines) such that the interior 206 of the body 202 is placed in fluid communication with and otherwise forms an axial extension of the interior of the conveyance 118.

The body 202 may include an upper sub 208*a* arranged at or near the first end 204*a*, a lower sub 208*b* arranged at or near the second end 204*b*, and a mandrel 210 that extends axially between the upper and lower subs 208*a,b*. In the illustrated embodiment, the upper sub 208*a* is coupled to the conveyance 118. The upper and lower subs 208*a,b* and the mandrel 210 may cooperatively define the interior 206 of the body 202.

As illustrated, the upper sub 208*a* may receive a portion of the mandrel 210 such that the mandrel 210 extends partially into the upper sub 208*a*. The mandrel 210 may include one or more seals 212 (three shown) configured to sealingly engage a seal bore 214 provided on the inner radial surface of the upper sub 208*a*. The seals 212 may comprise a variety of sealing devices that, in some embodiments, operate as dynamic seals. As used herein, the term "dynamic seal" refers to a seal that provides pressure and/or fluid isolation between members that have relative displacement therebetween, for example, a seal that seals against a displacing surface, or a seal carried on one member and sealing against the other member while both members are stationary or one member is moving with respect to the other. As described herein, the mandrel 210 may be configured to move axially or "telescope" with respect to the upper sub 204*a* and the seals 212 may be configured to "dynamically" seal against the seal bore 214 as the mandrel 210 moves.

The seals 212 may be made of a variety of materials including, but not limited to, an elastomeric material, a rubber, a metal, a composite, a ceramic, any derivative thereof, and any combination thereof. In some embodiments, as illustrated, the seals 212 may comprise O-rings or the like. In other embodiments, however, the seals 212 may comprise a set of v-rings or chevron packing rings, or another appropriate seal configuration (e.g., seals that are round, v-shaped, u-shaped, square, oval, t-shaped, etc.), as generally known to those skilled in the art. One or more of the seals 212 may alternatively comprise a molded rubber or elastomeric seal, a metal-to-metal seal (e.g., O-ring, crush ring, crevice ring, up stop piston type, down stop piston type, etc.), or any combination of the foregoing.

The lower sub 208*b* may be disposed about the outer circumference of the mandrel 210 at or near the second end 204*b*. In some embodiments, as illustrated, the mandrel 210 may extend through the lower sub 208*b* such that a portion of the mandrel 210 extends past the lower sub 208*b* on either axial end. In other embodiments, however, the mandrel 210 may extend into the lower sub 208*b* on the uphole end but not all the way through to the downhole end. The lower sub 208*b* may be coupled to the mandrel 210 such that axial movement of the mandrel 210 in the downhole direction (i.e., to the right in FIGS. 2-4) with respect to the upper sub 208*a* correspondingly moves the lower sub 208*b* in the same direction. In at least one embodiment, for instance, the lower sub 208*b* may be threaded to the outer circumference of the mandrel 210, but could alternatively be mechanically fastened or welded thereto. One or more seals 216 (three shown) may be used to fluidly seal the interface between the lower sub 208*b* and the mandrel 210. The seals 216 are depicted as O-rings, but could alternatively comprise any of the seals or sealing devices mentioned herein with respect to the seals 212.

In the unset configuration, as shown in FIG. 2, the mandrel 210 is operatively coupled to the upper sub 208*a* such that relative movement between the mandrel 210 and the upper sub 208*a* is prevented. This may prove advantageous in preventing the mandrel 210 from shifting or moving axially with respect to the upper sub 208*a* while the device 200 is being run into the wellbore 106 to the target location. The device 200 may include an upper lock ring 218*a* and an upper shoe 220 that cooperatively couple the mandrel 210 to the upper sub 208*a*. More particularly, the upper lock ring 218*a* may be coupled to (e.g., threaded, mechanically fastened, etc.) and extend axially from the upper sub 208*a*, and the upper shoe 220 may be coupled to (e.g., threaded, mechanically fastened, etc.) and extend axially from the upper lock ring 218*a*. The upper shoe 220 may further be coupled to the mandrel 210 using one or more shearable devices 222, such as a shear pin, a shear screw, or a shear ring. As described below, an axial load may be assumed by the mandrel 210 and, once a predetermined shear limit is reached, the shearable devices 222 may fail and thereby free the mandrel 210 from the upper shoe 220 such that the mandrel 210 is able to move axially with respect to the upper sub 208*a*.

The device 200 may further include one or more sealing elements 224 (three shown) disposed about the body 202 and, more particularly, about the outer circumference of the mandrel 210. The sealing element 224 may be made of a variety of pliable or supple materials such as, but not limited to, an elastomer, a rubber (e.g., nitrile butadiene rubber, hydrogenated nitrile butadiene rubber), a polymer (e.g., polytetrafluoroethylene or TEFLON®, AFLAS®; CHEMRAZ®, etc.), a ductile metal (e.g., brass, aluminum, ductile steel, etc.), or any combination thereof.

The device 200 also includes an upper slip assembly 226*a* and a lower slip assembly 226*b* arranged about the body 202 and positioned on opposing first and second axial ends of the sealing element 224. The upper slip assembly 226*a* includes an upper slip support 227, an upper slip wedge 228*a*, and a corresponding set of upper slips 230*a*, and the lower slip assembly 226*b* includes a lower slip wedge 228*b* and a corresponding set of lower slips 230*b*. The upper slip support 227 may be coupled to (e.g., threaded, mechanically fastened, shrink fitted, etc.) the outer radial surface of the mandrel 210 such that axial movement of the mandrel 210 in the downhole direction correspondingly moves the upper slip support 227 in the same direction. The upper slip support 227 may also be coupled to and otherwise axially engageable with the upper slips 230*a*. In moving the device 200 to the fully set configuration, the upper slip support 227 axially engages the upper slips 230*a* and urges the upper slips 230*a* to slidingly engage one or more ramped surfaces 234 (two shown) of the upper slip wedge 228*a* and thereby extend radially outward and toward the inner radial surface of the casing 114.

The upper and lower slips 230*a,b* may each comprise a plurality of slip segments circumferentially disposed about the corresponding upper and lower slip wedges 228*a,b*. Each segment of the upper and lower slips 230*a,b* may include one or more gripping devices 232 positioned or otherwise provided on its outer radial periphery and used to contact and grippingly engage the inner radial surface of the casing 114. In the illustrated embodiment, the gripping devices 232 are depicted as a series of teeth or serrated edges defined on the outer radial surface of the upper and lower slips 230*a,b*. In other embodiments, however, the gripping devices 232 may alternatively comprise discs made of a hard or ultra-hard material, such as ceramic, tungsten carbide, or synthetic diamond. In such embodiments, the discs may be coupled to or otherwise embedded within the outer surface of the corresponding upper and lower slips 230*a,b*.

As the device 200 moves to the fully set configuration, the upper and lower slip wedges 228*a,b* are configured to axially translate toward each other and thereby cooperatively compress the sealing element 224, which results in the radial expansion and sealing engagement of the sealing element 224 with the inner radial surface of the casing 114. Moreover, as the upper and lower slip wedges 228*a,b* translate axially toward each other, the upper and lower slips 230*a,b* slidingly engage outer ramped surfaces 234 of the corresponding upper and lower slip wedges 228*a,b* and thereby urge the upper and lower slips 230*a,b* radially outward and toward the inner radial surface of the casing 114. Eventually the gripping devices 232 of the upper and lower slips 230*a,b* are brought into contact with and grippingly engage (also referred to as "biting into") the inner radial surface of the casing 114. Grippingly engaging the inner radial surface of the casing 114 with the gripping devices 232 prevents the upper and lower slip wedges 228*a,b* from subsequently moving away from each other in opposing axial directions, and thereby prevents the sealing element 224 from radially contracting.

The device 200 may further include a setting piston 236 and a lower lock ring 218*b*. The setting piston 236 may be at least partially arranged in a piston chamber 238 cooperatively defined by the lower sub 208*b* and the underlying mandrel 210, and may be coupled to the lower sub 208*b* with one or more shearable devices 242 (e.g., a shear pin, a shear screw, a shear ring, etc.). In moving the device 200 to the fully set configuration, an axial load may be applied to the setting piston 236 in the form of hydraulic pressure introduced into the piston chamber 238. Once the axial load reaches a predetermined shear limit, the shearable devices 242 will fail and thereby free the setting piston 236 from the lower sub 208*b* such that the setting piston 236 is able to move axially with respect to the lower sub 208*b*.

The lower lock ring 218*b* may be coupled to and otherwise axially engageable with the setting piston 236 such that axial movement of the setting piston 236 in the uphole direction (i.e., to the left in FIGS. 2-4) correspondingly moves the lower lock ring 218*b* in the same direction. The lower lock ring 218*b* may be positioned axially adjacent the lower slips 230*b* and configured to axially engage the lower slips 230*b* as the device 200 transitions to the partially and fully set configurations. When the setting piston 236 is actuated and acts on the lower lock ring 218*b*, the lower lock ring 218*b* correspondingly acts on the lower slips 230*b* and urges the lower slips 230*b* to slidingly engage the one or more ramped surfaces 234 (two shown) of the lower slip wedge 228*b* and thereby extend radially outward and toward the inner radial surface of the casing 114.

The device 200 may further include a mandrel plugging device 244 positioned within or capable of being positioned within the interior 206 of the body 202 and, more particularly, within the mandrel 210. The mandrel plugging device 244 may be coupled to the mandrel 210 and configured to plug or otherwise form a plug within the mandrel 210 such that hydraulic pressure applied within the interior 206 acts on the mandrel plugging device 244 and urges the mandrel 210 to move axially downhole (i.e., to the right in FIGS. 2-4).

The mandrel plugging device 244 may comprise any mechanical, electromechanical, hydraulic, or chemical means that can be coupled to the mandrel 210 and operate to plug the interior 206 to actuate the mandrel 210. For example, the mandrel plugging device 244 may comprise a pump-out-plug, a ball and seat catcher sub, a collet catcher sub, a landing nipple, a landing plug, a dissolving plug, a tubing dart, or any combination thereof. In some embodiments, as illustrated, the mandrel plugging device 244 may include a setting or sliding sleeve that is axially movable within the interior 206. For purposes of discussion, the mandrel plugging device 244 will be referred to and depicted herein as a "setting sleeve 244."

As illustrated, the setting sleeve 244 may include one or more setting pins 246 spaced circumferentially about the setting sleeve 244 and extending radially through corresponding setting ports 248 defined in or through the mandrel 210. The setting ports 248 facilitate fluid communication between the interior 206 and the piston chamber 238. In some embodiments, the setting ports 248 may comprise elongate slots that receive the setting pins 246 for axial translation therein. The setting sleeve 244 may be transitioned between a first or "unactuated" state, where the setting sleeve 244 substantially occludes the setting ports 248, as shown in FIG. 2, and a second or "actuated" state, where the setting sleeve 244 has moved axially to at least partially expose the setting ports 248, as shown in FIGS. 3 and 4. In the first state, the setting sleeve 244 straddles the setting ports 248 and seals 250 (e.g., O-rings or the like) provided on opposing axial ends of the setting ports 248 may provide a fluid seal that prevents fluids from migrating into or out of the piston chamber 238 via the setting ports 248. This may prove advantageous in preventing drilling fluids or other high-density fluids from plugging the setting ports 248 while running the device 200 into the wellbore 106.

The setting sleeve 244 may be secured in the first state with one or more shearable devices 252 (e.g., a shear pin, a shear screw, a shear ring, etc.) that couple the setting sleeve 244 to the mandrel 210. Shearing the shearable devices 252 allows the setting sleeve 244 to move to the second state and thereby allows fluid pressure within the interior 206 to communicate with the piston chamber 238 via the setting ports 248 and act on the setting piston 236.

Exemplary operation of the device 200 in transitioning between the unset configuration, as shown in FIG. 2, and the partially set configuration, as shown in FIG. 3, is now provided. The device 200 may be run into the wellbore 106 as coupled to the conveyance 118 until locating a target destination (location) where the device 200 is to be deployed and thereby seal the wellbore 106. Upon reaching the target destination, the setting sleeve 244 (i.e., the mandrel plugging device) may be actuated (e.g., activated, set, deployed, etc.) to plug (seal) the interior 206. In the illustrated embodiment, for example, the mandrel plugging device 244 may further include a wellbore projectile 302 (FIG. 3) that may be introduced into the conveyance 118 and advanced to the device 200. The wellbore projectile 302 may comprise, but is not limited to, a dart, a plug, or a ball. In some embodiments, the wellbore projectile 302 may be pumped to the device 200. In other embodiments, however, the wellbore projectile 302 may be run in on coil tubing or wireline, or may freely fall to device 200 under the force of gravity. Upon reaching the device 200, the wellbore projectile 302 may locate and otherwise land on a seat provided on the setting sleeve 244 and thereby generate a hydraulic seal within the interior 206 of the body 202.

Increasing the fluid pressure within the interior 206 above (uphole from) the setting sleeve 244 will result in a hydraulic load being placed on the wellbore projectile 302, which correspondingly places an axial load on the setting sleeve 244 in a first or "downhole" direction A. The fluid pressure within the interior 206 may be increased to a first pressure, where the resulting axial load surpasses a predetermined shear limit of the shearable device(s) 252. Accordingly, increasing the pressure within the interior 206 to the first pressure may detach the setting sleeve 244 from the mandrel 210 and allow the setting sleeve 244 to move to the second state (FIG. 3) where the setting pins 246 engage corresponding axial ends of the setting ports 248 to stop the axial movement of the setting sleeve 244. Moving the setting sleeve 244 to the second state exposes the setting ports 248 and facilitates fluid communication between the interior 206 and the piston chamber 238.

With the setting ports 248 exposed, the hydraulic pressure within the interior 206 may then be able to act on the setting piston 236 within the piston chamber 238, which results in an axial load being assumed on the setting piston 236 in a second or "uphole" direction B, where the second direction B is opposite the first direction A. The axial load assumed on the setting piston 236 is transferred to the shearable device (s) 242, which couples the setting piston 236 to the lower sub 208. Once a predetermined shear limit is reached, the shearable device(s) 242 will fail and allow the setting piston 236 to move axially with respect to the lower sub **208*b* in the second direction B and axially engage the lower lock ring 218*b*. As the setting piston 236 moves axially in the second direction B, the lower lock ring 218*b* correspondingly moves in the second direction B and acts on the lower slips 230*b* and urges the lower slips 230*b* to slidingly engage the ramped surface(s) 234 of the lower slip wedge 228*b*. Slidingly engaging the ramped surface(s) 234 of the lower slip wedge 228*b* urges the lower slips 230*b* to extend (expand) radially outward and toward the inner radial surface of the casing 114 where the gripping devices 232 eventually grippingly engage ("bite into") the inner radial surface of the casing 114**.

In some embodiments, urging the lower slips **230*b* against the lower slip wedge 228*b* may also urge the lower slip wedge 228*b* to move axially in the second direction B with respect to the mandrel 210 and provide a corresponding axial load on the sealing element 224. In such embodiments, the sealing element 224 may be axially compressed by the lower slip wedge 228*b* and thereby urged to extend radially toward and sealingly engage the inner radial surface of the casing 114. Moreover, in such embodiments, the lower slip wedge 228*b* may be coupled to the mandrel 210 with one or more shearable devices 304 (e.g., a shear pin, a shear screw, a shear ring, etc.), and urging the lower slips 230*b* against the lower slip wedge 228*b* may break or fail the shearable devices 304 to allow the lower slip wedge 228*b* to move axially with respect to the mandrel 210**.

In at least one embodiment, the lower lock ring **218*b* may include an anti-reverse mechanism 306 that allows the lower lock ring 218*b* to move in the second direction B with respect to the mandrel 210, but prevents the lower lock ring 218*b* from moving in the first direction A with respect to the mandrel 210. In the illustrated embodiment, the anti-reverse mechanism 306 is depicted as a series of grooves or teeth defined on the inner radial surface of the lower lock ring 218*b*. The teeth may be angled such that the lower lock ring 218*b* is able to advance in the second direction B, but the teeth bite into and otherwise grippingly engage the outer surface of the mandrel 210 when the lower lock ring 218*b* attempts to move in the first direction A, and thereby prevents such movement. Accordingly, the anti-reverse mechanism 306 may help maintain axial force on the lower slips 230*b* and thereby prevents the lower slips 230*b* from disengaging from the inner radial surface of the casing 114. This may also help maintain the sealing element 224 radially expanded and in sealed engagement with the casing 114. The anti-reverse mechanism 306 may prove advantageous in the event fluid pressure within the interior 206 is lost, which would remove the axial load on the setting piston 236 and otherwise allow the lower slips 230*b* and the sealing element 224** to radially retract.

While the anti-reverse mechanism 306 is depicted and described herein as a series of teeth or grooves, other types and designs of the anti-reverse mechanism 306 may alternatively be employed to accomplish the same purpose, without departing from the scope of the disclosure. In other embodiments, for instance, the anti-reverse mechanism 306 may include a snap ring (not shown), or a similar mechanism or device, configured to radially contract and seat within a groove (not shown) defined on the outer surface of the mandrel 210 once the lower lock ring 218*b* has advanced in the second direction B to a predetermined location. The snap ring would prevent the lower lock ring 218*b* from retracting backwards in the first direction A.

Exemplary operation of the device 200 in transitioning between the partially set configuration, as shown in FIG. 3, and the fully set configuration, as shown in FIG. 4, is now provided. With some axial resistance obtained with the lower slips 230*b* and the sealing element 224 engaged against the inner radial surface of the casing 114, moving the mandrel 210 in the first direction A transitions the device 200 to the fully set configuration where the upper slips 230*a* are engaged against the inner radial surface of the casing 114 and the sealing element 224 are fully compressed and expanded to provide a robust fluidic seal in the wellbore 106. To move the mandrel 210, the fluid pressure within the interior 206 may be increased to a second pressure, where the second pressure is greater than the first pressure required to actuate the setting sleeve 244 and the setting piston 236. Increasing the fluid pressure within the interior 206 to the second pressure will result in an increased hydraulic load being placed on the wellbore projectile 302, which correspondingly places an increased axial load on the setting sleeve 244 in the first direction A. This increased axial load may be assumed by the setting pins 246 as extended through the setting ports 248, which transfers the increased axial load to mandrel 210 and, more particularly, to the shearable devices 222 that couple the mandrel 210 to the upper shoe 220. Once a predetermined shear limit is reached, the shearable devices 222 may fail and thereby free the mandrel 210 from the upper shoe 220.

In some embodiments, the second pressure may be the same as the first pressure. More particularly, maintaining the pressure within the interior 206 at the first pressure may also cause the mandrel 210 to move since the lower slips 230*b* and the sealing element 224 may be at least partially engaged against the inner radial surface of the casing 114, as described above. Once the sealing element 224 seals against the casing 114 and the resulting friction pushes back on the setting piston 236, a larger piston area results and the first pressure may, therefore be sufficient to force the mandrel 210 to move axially. Accordingly, in such embodiments, pressurizing the interior to the second pressure may denote maintaining the level of the first pressure.

Once the shearable devices 222 fail, the mandrel 210 may be able to move axially with respect to the upper sub 208*a* and otherwise telescope out of a portion of the seal bore 214 in the first direction A. As the mandrel 210 moves in the first direction A, the upper slip support 227 correspondingly moves and axially engages the upper slips 230*a* and urges the upper slips 230*a* to slidingly engage the ramped surface (s) 234 of the upper slip wedge 228*a*. Slidingly engaging the ramped surface(s) 234 of the upper slip wedge 228*a* urges the upper slips 230*a* to extend (expand) radially outward and toward the inner radial surface of the casing 114 where the gripping devices 232 eventually grippingly engage ("bite into") the inner radial surface of the casing 114.

Moreover, urging the upper slips 230*a* against the upper slip wedge 228*a* also urges the upper slip wedge 228*a* to move axially in the first direction A with respect to the mandrel 210 and provides a corresponding axial load on the sealing element 224. With the lower slips 230*b* already engaged against the casing 114, as discussed above, the sealing element 224 will be axially compressed between the upper and lower slip wedges 228*a,b* and thereby urged to extend even further into sealed engagement with the inner radial surface of the casing 114. Similar to the lower slip wedge 228*b*, the upper slip wedge 228*a* may also be coupled to the mandrel 210 with one or more shearable devices 304 (e.g., a shear pin, a shear screw, a shear ring, etc.). Urging the upper slips 230*a* against the upper slip wedge 228*a* will result in the shearable devices 304 failing to allow the upper slip wedge 228*a* to move axially with respect to the mandrel 210.

Similar to the lower lock ring 218*b*, the upper lock ring 218*a* may also include an anti-reverse mechanism 308 that allows the mandrel 210 to move in the first direction A with respect to the upper sub 208*a*, but prevents the mandrel 210 from reversing direction in the second direction B. Similar to the anti-reverse mechanism 306 of the lower lock ring 218*b*, the anti-reverse mechanism 308 may comprise a series of grooves or teeth defined on the inner radial surface of the upper lock ring 218*a*. The teeth may be angled such that the mandrel 210 is able to advance in the first direction A, but the teeth bite will into and otherwise grippingly engage the outer surface of the mandrel 210 when the mandrel 210 attempts to move in the second direction B, and thereby prevents such movement.

Moreover, similar to the anti-reverse mechanism 306 of the lower lock ring 218*b*, the anti-reverse mechanism 308 may alternatively include a snap ring (not shown), or a similar mechanism or device, configured to radially contract and seat within a groove (not shown) defined on the outer surface of the mandrel 210 once the mandrel 210 has advanced in the first direction A to a predetermined location. The snap ring would prevent the mandrel 210 from retracting backwards in the second direction B.

Accordingly, the anti-reverse mechanisms 306, 308 help maintain axial force on the upper and lower slips 230*aa,b* and thereby prevent the upper and lower slips 230*a,b* from disengaging the inner radial surface of the casing 114. This will also help maintain the sealing element 224 radially expanded and in sealed engagement with the casing 114. This two directional locking system ensures that the device 200 will be maintained in the fully set configuration and not relax.

With the device 200 in the fully set configuration, in some embodiments, the pressure within the interior 206 may be increased to a third pressure that is greater than the second pressure. The third pressure will result in an increased hydraulic load being placed on the wellbore projectile 302, which correspondingly places an increased axial load on the setting sleeve 244 in the first direction A. This increased axial load may again be assumed by the setting pins 246 as extended through the setting ports 248 and, upon the axial load reaching a predetermined shear limit, the setting pins 246 may be configured to fail and thereby free the setting sleeve 244 from the mandrel 210. The setting sleeve 244 may then be expended to the bottom of the wellbore 106 or returned to the surface.

Accordingly, the device 200 differs from conventional wellbore isolation devices in several aspects. For instance, in a conventional hydraulic set wellbore isolation device, the mandrel is directly coupled to the conveyance (work string) above the wellbore isolation device. With the device 200 described herein, however, the mandrel 210 is free floating within the seal bore 214 of the upper sub 204*a*, which is directly coupled to the conveyance 118 above the device 200. The floating mandrel 210 of the device 200 allows for piston-induced loads from the plugged mandrel 210 inner diameter to pull the mandrel 210 in the first direction A along with the upper slips 230*a*, and thereby place significant setting force into the upper and lower slips 230*a,b* and the sealing element 224. The floating mandrel 210 allows for utilizing this additional setting force without placing the conveyance 118 above the device 200 in excessive tension, which is typically seen with conventional hydraulic set wellbore isolation devices where downward movement of the mandrel is utilized to supply additional setting force.

Another difference is the placement and function of the mandrel plugging device (i.e., the setting sleeve). In conventional wellbore isolation devices, the mandrel plugging device is typically located in tubing below (downhole from) the wellbore isolation device. In contrast, the mandrel plugging device 244 of the device 200 is coupled to the mandrel 210 and thereby forms an integral part of the device 200 that will remain a part of the device 200 until the setting sequence is completed.

Embodiments disclosed herein include:

A. A method that includes introducing a wellbore isolation device into a wellbore lined with casing, the wellbore isolation device including an elongate body that defines an interior and comprises an upper sub, a lower sub, and a mandrel extending between the upper and lower subs, a sealing element disposed about the mandrel, an upper slip assembly positioned on a first axial end of the sealing element and a lower slip assembly positioned on a second axial end of the sealing element, a setting piston positioned within a piston chamber cooperatively defined by the lower sub and the mandrel, and a mandrel plugging device positioned within the mandrel. The method further including plugging the interior with the mandrel plugging device, transitioning the mandrel plugging device from a first state, where the mandrel plugging device occludes setting ports defined in the mandrel, to a second state, where the setting ports are exposed to facilitate fluid communication between the interior and the piston chamber, pressurizing the interior to a first pressure and thereby actuating the setting piston to set the lower slip assembly within the casing on the second axial end, and pressurizing the interior to a second pressure at or greater than the first pressure and thereby moving the mandrel with respect to the upper sub and setting the upper slip assembly within the casing on the first axial end.

B. A wellbore isolation device that includes an elongate body that defines an interior and comprises an upper sub, a lower sub, and a mandrel extending between the upper and lower subs, a sealing element disposed about the mandrel and having a first axial end and a second axial end, an upper slip assembly positioned on the first axial end and a lower slip assembly positioned on the second axial end, a setting piston positioned within a piston chamber cooperatively defined by the lower sub and the mandrel and actuatable to act on the lower slip assembly, a mandrel plugging device positioned within the mandrel and transitionable between a first state, where the mandrel plugging device plugs the interior and occludes setting ports defined in the mandrel, and a second state, where the setting ports are exposed to facilitate fluid communication between the interior and the piston chamber and thereby actuate the setting piston, wherein pressurizing the interior with a first pressure actuates the setting piston and sets the lower slip assembly within the casing on the second axial end, and wherein pressurizing the interior to a second pressure at or greater than the first pressure moves the mandrel with respect to the upper sub and sets the upper slip assembly within the casing on the first axial end.

Each of embodiments A and B may have one or more of the following additional elements in any combination: Element 1: wherein the mandrel plugging device includes a setting sleeve and a wellbore projectile, and wherein plugging the interior with the mandrel plugging device comprises conveying the wellbore projectile to the setting sleeve, and landing the wellbore projectile on a seat provided on the setting sleeve and thereby forming a hydraulic seal in the interior. Element 2: wherein transitioning the mandrel plugging device from the first state to the second state comprises placing a hydraulic load on the wellbore projectile with the first pressure and thereby placing a corresponding first axial load on the setting sleeve, and axially translating the setting sleeve within the mandrel to the second state as acted upon by the corresponding first axial load. Element 3: wherein the setting sleeve includes one or more setting pins extending radially from the setting sleeve and through a corresponding one or more of the setting ports, and wherein axially translating the setting sleeve within the mandrel to the second state comprises engaging the one or more setting pins on an axial end of the corresponding one or more of the setting ports and thereby stopping axial movement of the setting sleeve. Element 4: wherein pressurizing the interior to the second pressure comprises placing a hydraulic load on the wellbore projectile with the second pressure and thereby placing a corresponding second axial load on the mandrel via engagement of the one or more setting pins against the axial end of the corresponding one or more of the setting ports, and telescoping the mandrel out of the upper sub as acted upon by the corresponding second axial load. Element 5: wherein the setting sleeve includes one or more setting pins extending radially from the setting sleeve and through a corresponding one or more of the setting ports, the method further comprising pressurizing the interior to a third pressure greater than the second pressure, placing a hydraulic load on the wellbore projectile with the third pressure and thereby placing a corresponding third axial load on the one or more setting pins extended through the corresponding one or more of the setting ports, failing the one or more setting pins as acted upon by the corresponding third axial load and thereby freeing the setting sleeve from the mandrel, and removing the setting sleeve from the mandrel. Element 6: wherein the upper sub provides a seal bore that receives a portion of the mandrel, the method further comprising sealing an interface between the seal bore and the mandrel with one or more seals. Element 7: wherein the lower slip assembly includes a lower slip wedge and one or more lower slips, and wherein actuating the setting piston comprises urging the one or more lower slips against a ramped surface of the lower slip wedge and thereby extending the one or more lower slips radially outward and into engagement with an inner radial surface of the casing, and grippingly engaging the inner radial surface of the casing with a gripping device provided on the one or more lower slips. Element 8: further comprising urging the lower slip wedge against the sealing element on the second axial end and thereby axially compressing the sealing element with the lower slip wedge to sealingly engaging the inner radial surface of the casing with the sealing element. Element 9: wherein the upper slip assembly includes an upper slip wedge and one or more upper slips, and wherein setting the upper slip assembly within the casing on the first axial end comprises urging the one or more upper slips against a ramped surface of the upper slip wedge and thereby extending the one or more upper slips radially outward and into engagement with the inner radial surface of the casing, grippingly engaging the inner radial surface of the casing with a gripping device provided the one or more upper slips, urging the upper slip wedge against the sealing element on the first axial, and axially compressing the sealing element between the upper and lower slip wedges and thereby sealingly engaging the inner radial surface of the casing with the sealing element. Element 10: wherein moving the mandrel with respect to the upper sub comprises shearing one or more shearable devices that operatively couple the mandrel to the upper sub. Element 11: wherein introducing the wellbore isolation device into the wellbore comprises conveying the wellbore isolation device into the wellbore on a conveyance coupled to the upper sub.

Element 12: wherein the mandrel plugging device comprises, a setting sleeve axially movable within the interior and including one or more setting pins extending radially from the setting sleeve and through a corresponding one or more of the setting ports, and a wellbore projectile configured to locate a seat provided on the setting sleeve and thereby generate a hydraulic seal within the interior. Element 13: further comprising a lower lock ring disposed about the mandrel on the second axial end to prevent the setting piston from retracting within the piston chamber after actuation and thereby maintain the lower slip assembly set within the casing, and an upper lock ring disposed about the mandrel and operatively coupled to the upper sub to prevent the mandrel from retracting back into the upper sub after the mandrel moves with respect to the upper sub and thereby maintain the upper slip assembly set within the casing. Element 14: wherein lower lock ring and the upper lock ring each include an anti-reverse mechanism comprising a series of teeth that grippingly engage an outer surface of the mandrel. Element 15: wherein the mandrel extends partially into and sealingly engages a seal bore of the upper sub. Element 16: wherein the lower sub is disposed about the mandrel and the mandrel extends through the lower sub such that a portion of the mandrel extends past the lower sub on opposing axial ends of the lower sub.

By way of non-limiting example, exemplary combinations applicable to A and B include: Element 1 with Element 2; Element 2 with Element 3; Element 3 with Element 4; Element 1 with Element 5; Element 7 with Element 8; Element 7 with Element 9; and Element 13 with Element 14.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A method, comprising:

introducing a wellbore isolation device into a wellbore lined with casing, the wellbore isolation device including:

an elongate body that defines an interior and comprises an upper sub, a lower sub, and a mandrel extending between the upper and lower subs;

a sealing element disposed about the mandrel;

an upper slip assembly positioned on a first axial end of the sealing element and a lower slip assembly positioned on a second axial end of the sealing element;

a setting piston positioned within a piston chamber cooperatively defined by the lower sub and the mandrel; and a mandrel plugging device positioned within the mandrel;

plugging the interior with the mandrel plugging device;

transitioning the mandrel plugging device from a first state, where the mandrel plugging device occludes setting ports defined in the mandrel, to a second state, where the setting ports are exposed to facilitate fluid communication between the interior and the piston chamber;

pressurizing the interior to a first pressure and thereby actuating the setting piston to set the lower slip assembly within the casing on the second axial end; and pressurizing the interior to a second pressure at or greater than the first pressure and thereby moving the mandrel with respect to the upper sub and setting the upper slip assembly within the casing on the first axial end.

2. The method of claim 1, wherein the mandrel plugging device includes a setting sleeve and a wellbore projectile, and wherein plugging the interior with the mandrel plugging device comprises conveying:

the wellbore projectile to the setting sleeve; and landing the wellbore projectile on a seat provided on the setting sleeve and thereby forming a hydraulic seal in the interior.

3. The method of claim 2, wherein transitioning the mandrel plugging device from the first state to the second state comprises:

placing a hydraulic load on the wellbore projectile with the first pressure and thereby placing a corresponding first axial load on the setting sleeve; and axially translating the setting sleeve within the mandrel to the second state as acted upon by the corresponding first axial load.

4. The method of claim 3, wherein the setting sleeve includes one or more setting pins extending radially from the setting sleeve and through a corresponding one or more of the setting ports, and wherein axially translating the setting sleeve within the mandrel to the second state comprises engaging the one or more setting pins on an axial end of the corresponding one or more of the setting ports and thereby stopping axial movement of the setting sleeve.

5. The method of claim 4, wherein pressurizing the interior to the second pressure comprises:

placing a hydraulic load on the wellbore projectile with the second pressure and thereby placing a corresponding second axial load on the mandrel via engagement of the one or more setting pins against the axial end of the corresponding one or more of the setting ports; and telescoping the mandrel out of the upper sub as acted upon by the corresponding second axial load.

6. The method of claim 2, wherein the setting sleeve includes one or more setting pins extending radially from the setting sleeve and through a corresponding one or more of the setting ports, the method further comprising:

pressurizing the interior to a third pressure greater than the second pressure;

placing a hydraulic load on the wellbore projectile with the third pressure and thereby placing a corresponding third axial load on the one or more setting pins extended through the corresponding one or more of the setting ports;

failing the one or more setting pins as acted upon by the corresponding third axial load and thereby freeing the setting sleeve from the mandrel; and removing the setting sleeve from the mandrel.

7. The method of claim 1, wherein the upper sub provides a seal bore that receives a portion of the mandrel, the method further comprising sealing an interface between the seal bore and the mandrel with one or more seals.

8. The method of claim 1, wherein the lower slip assembly includes a lower slip wedge and one or more lower slips, and wherein actuating the setting piston comprises:

urging the one or more lower slips against a ramped surface of the lower slip wedge and thereby extending the one or more lower slips radially outward and into engagement with an inner radial surface of the casing; and grippingly engaging the inner radial surface of the casing with a gripping device provided on the one or more lower slips.

9. The method of claim 8, further comprising urging the lower slip wedge against the sealing element on the second axial end and thereby axially compressing the sealing element with the lower slip wedge to sealingly engaging the inner radial surface of the casing with the sealing element.

10. The method of claim 8, wherein the upper slip assembly includes an upper slip wedge and one or more upper slips, and wherein setting the upper slip assembly within the casing on the first axial end comprises:

urging the one or more upper slips against a ramped surface of the upper slip wedge and thereby extending the one or more upper slips radially outward and into engagement with the inner radial surface of the casing;

grippingly engaging the inner radial surface of the casing with a gripping device provided the one or more upper slips;

urging the upper slip wedge against the sealing element on the first axial; and axially compressing the sealing element between the upper and lower slip wedges and thereby sealingly engaging the inner radial surface of the casing with the sealing element.

11. The method of claim 1, wherein moving the mandrel with respect to the upper sub comprises shearing one or more shearable devices that operatively couple the mandrel to the upper sub.

12. The method of claim 1, wherein introducing the wellbore isolation device into the wellbore comprises conveying the wellbore isolation device into the wellbore on a conveyance coupled to the upper sub.

13. A wellbore isolation device, comprising:

an elongate body that defines an interior and comprises an upper sub, a lower sub, and a mandrel extending between the upper and lower subs;

a sealing element disposed about the mandrel and having a first axial end and a second axial end;

an upper slip assembly positioned on the first axial end and a lower slip assembly positioned on the second axial end;

a setting piston positioned within a piston chamber cooperatively defined by the lower sub and the mandrel and actuatable to act on the lower slip assembly;

a mandrel plugging device positioned within the mandrel and transitionable between a first state, where the mandrel plugging device plugs the interior and occludes setting ports defined in the mandrel, and a second state, where the setting ports are exposed to facilitate fluid communication between the interior and the piston chamber and thereby actuate the setting piston, wherein pressurizing the interior with a first pressure actuates the setting piston and sets the lower slip assembly within the casing on the second axial end, and wherein pressurizing the interior to a second pressure at or greater than the first pressure moves the mandrel with respect to the upper sub and sets the upper slip assembly within the casing on the first axial end.

14. The wellbore isolation device of claim 13, wherein the mandrel plugging device comprises:

a setting sleeve axially movable within the interior and including one or more setting pins extending radially from the setting sleeve and through a corresponding one or more of the setting ports; and a wellbore projectile configured to locate a seat provided on the setting sleeve and thereby generate a hydraulic seal within the interior.

15. The wellbore isolation device of claim 13, further comprising:

a lower lock ring disposed about the mandrel on the second axial end to prevent the setting piston from retracting within the piston chamber after actuation and thereby maintain the lower slip assembly set within the casing; and an upper lock ring disposed about the mandrel and operatively coupled to the upper sub to prevent the mandrel from retracting back into the upper sub after the mandrel moves with respect to the upper sub and thereby maintain the upper slip assembly set within the casing.

16. The wellbore isolation device of claim 15, wherein lower lock ring and the upper lock ring each include an anti-reverse mechanism comprising a series of teeth that grippingly engage an outer surface of the mandrel.

17. The wellbore isolation device of claim 13, wherein the mandrel extends partially into and sealingly engages a seal bore of the upper sub.

18. The wellbore isolation device of claim 13, wherein the lower sub is disposed about the mandrel and the mandrel extends through the lower sub such that a portion of the mandrel extends past the lower sub on opposing axial ends of the lower sub.

* * * * *